United States Patent [19]

Lochbronner

[11] Patent Number: 4,988,048

[45] Date of Patent: Jan. 29, 1991

[54] METHOD AND DEVICE FOR WINDING CROSS-WOUND BOBBINS

[75] Inventor: Hubert Lochbronner, Lenting, Fed. Rep. of Germany

[73] Assignee: Schubert & Salzer, Maschinenfabrik Aktiengesellschaft, Ingolstadt, Fed. Rep. of Germany

[21] Appl. No.: 315,050

[22] Filed: Feb. 23, 1989

[30] Foreign Application Priority Data

Feb. 24, 1988 [DE] Fed. Rep. of Germany ..... 3805656

[51] Int. Cl.[5] ..... B65H 54/42; B65H 59/38

[52] U.S. Cl. ..... 242/18 R; 242/18 CS; 242/18 DD; 242/35.6 R; 242/45

[58] Field of Search ..... 242/18 R, 18 CS, 18 DD, 242/18 EW, 18 PW, 35.5 A, 35.6 R, 45; 57/263

[56] References Cited

U.S. PATENT DOCUMENTS

| | | | |
|---|---|---|---|
| 3,938,306 | 2/1976 | Bous | 57/263 |
| 4,089,480 | 5/1978 | Kamp | 242/18 DD |
| 4,105,166 | 8/1978 | Mackie | 242/45 |
| 4,501,116 | 2/1985 | Schuller et al. | 57/263 |
| 4,789,107 | 12/1988 | Hauser et al. | 242/45 |

FOREIGN PATENT DOCUMENTS

252592A1 12/1987 German Democratic Rep. .

*Primary Examiner*—John Petrakes
*Attorney, Agent, or Firm*—Dority & Manning

[57] ABSTRACT

Method and apparatus includes determining the actual outer diameter of a bobbin or empty casing in the axial region thereof upon which a thread is being taken up. The drive velocity of the bobbin or empty casing is then changed relative to operating velocity as a function of the determined actual outer diameter of the bobbin or empty casing. Such adjustment corrects the circumferential velocity of the bobbin or empty casing in the take-up region of the thread for correspondence with the thread supply velocity. Otherwise, the circumferential velocity in such take-up region would deviate from the thread supply velocity on account of the conicity of the bobbin or empty casing.

14 Claims, 2 Drawing Sheets

FIG. 1
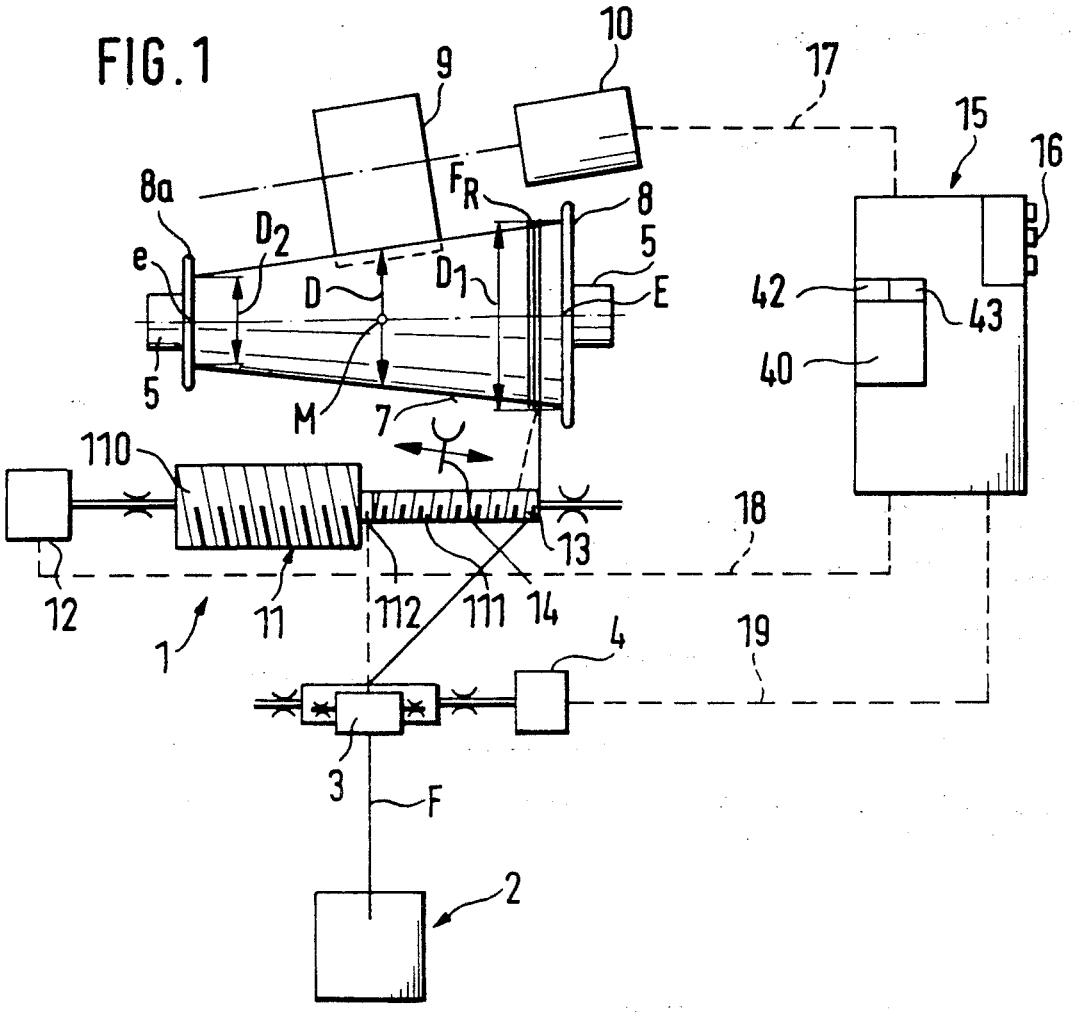
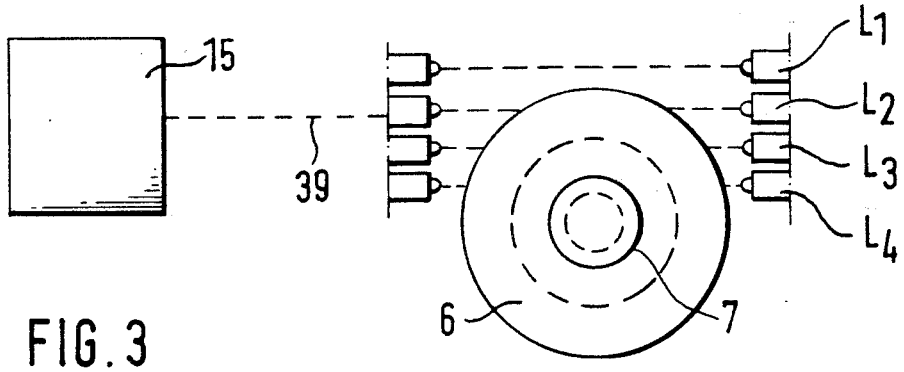
FIG. 3

METHOD AND DEVICE FOR WINDING CROSS-WOUND BOBBINS

BACKGROUND AND SUMMARY OF THE INVENTION

The invention relates to an improved method for winding conical cross-wound bobbins and a device for carrying out said method.

In a known method according to DE-OS-3 123 494, which corresponds with U.S. Pat. No. 4,501,116, a centering spindle is used during thread attachment, which spindle displaces the thread supplied with the aid of draw-off rollers to the end of the bobbin with the larger diameter, the bobbin being driven during thread attachment by means of an auxiliary drive roller. Since there is a marked difference between the circumferential velocity at each bobbin end and the circumferential velocity in the longitudinal center of the bobbin where the bobbin or empty casing is driven, in particular on account of the conicity of the bobbin or empty casing, it is customary to reduce the drive velocity of the bobbin or empty casing during thread attachment by an average of 2%. In this respect it is assumed that the thread is wound onto the end of the empty casing with the larger diameter. However, this general reduction in the bobbin drive velocity does not correspond to the differences in velocity which actually occur, so that thread breaks or rough handling of the thread will take place. The same applies to a thread attachment phase in which the thread can also be selectively wound onto the end of the bobbin or empty casing with the smaller diameter, the circumferential velocity then being too slow for a perfect thread uptake.

According to DE-OS-2 242 151, which corresponds with U.S. Pat. No. 3,938,306, an intermediate store is provided for the thread, which store compensates differences in velocity the size of the thread length stored being controlled by driving the bobbin or empty casing at varying speeds.

In DE-OS-2 458 853, which corresponds with U.S. Pat. No. 4,0899,480, the use of a plurality of drive rollers is proposed, which are distributed axially along the length of the bobbin and which are driven in succession synchronously with the movement of the shifting thread guide so as to wind the thread with substantially constant tension.

However, the methods mentioned above do not take into account the actual circumstances which result during thread attachment in the case of different bobbin conicities and different bobbin outer diameters.

It is the object of the invention to provide a method and a device in order to rule out the possibility of thread breaks or unevenness during winding in connection with thread attachment.

According to the invention, this object is attained through practice of the presently disclosed method and devices.

When reference is made to the conicity or the velocity of the bobbin, then according to the invention this is also understood to include the empty casing, onto which no thread has yet been wound.

The actual outer diameter of the bobbin is the value from which it is possible, provided that the conicity of the bobbin is known, to precisely determine the differences in circumferential velocity occuring between the longitudinal center of the bobbin and the bobbin ends during bobbin change-overs or thread attachments. In this connection, said actual outer diameter can be selectively determined at the large or small diameter or centrally between the two bobbin ends. As a result of the fact that the drive velocity of the bobbin is altered relative to the operating velocity as a strict function of the determined actual outer diameter, the thread approaching with the predetermined supply velocity runs correctly onto the bobbin, so that on the one hand thread breaks as a result of excessive thread tension and on the other hand uneveness in the winding pattern as a result of the low thread tension are reliably avoided. In this connection, it is advantageous during bobbin change-overs or thread attachments for the thread to be wound on unchanged with the respective adjustment supply velocity, so that the spinning process does not have to be unnecessarily interrupted or changed over.

In this respect, the present exemplary method of throttling operation is expedient, since the throttling of the drive velocity relative to the operating velocity as a function of the actual outer diameter of the bobbin corresponds exactly to the actual conditions, which leads to a considerably improved winding quality as compared with the known method with a general reduction of the drive velocity. The changes in the drive velocity effected strictly as a function of the determined actual outer diameter of the bobbin or empty casing allow thread attachments at high thread speeds. In such throttling operations, preferably the drive velocity during the winding of the thread at the end of the bobbin with the larger diameter is throttled relative to the operating speed as a function of the actual outer diameter.

In practice, the present exemplary method of operation of changing the drive velocity by up to 15 percent relative to the operating velocity has proved particularly expedient. The change in the drive velocity is carried out within this defined range of up to 15%. The change becomes smaller the larger the outer diameter of the bobbin and the slighter the conicity of the bobbin.

A further important present measure is that the actual central outer diameter of the diameter of the bobbin or empty casing is determined, transmitted by data transfer to the control unit, and evaluated there to determine the degree of required change in the drive velocity. The actual central outer diameter is the easiest value to determine using the method and device according to the invention. From the value of the actual central outer diameter it is possible to precisely determine the differences in velocity which result over the length of the bobbin between the bobbin ends. Data transmission is an error-free, sufficiently quick and therefore extraordinarily precise method, which is particularly suited to this type of problem. The evaluation and conversion of the determined values into the change in drive velocity is carried out in conventional manner using one or more microprocessors.

A further expedient method of operation is presently disclosed, in which, for the thread attachment, the bobbin held by bobbin carrier arms is swung out of the operating position into a predetermined bobbin release position. From the degree to which the bobbin is swung out or the time taken for the pivoting movement of the bobbin carrier arms from the operating position into the bobbin release position, the actual outer diameter can be precisely determined, components advantageously being used which are necessary anyway for the operation of the device.

A further expedient method of operation is presently disclosed, in which, for the thread attachment, an auxiliary drive roller can be moved from a passive position to abut against the circumference of the bobbin or empty casing. Here too, the degree of or time taken for the movement of the auxiliary drive roller between the predetermined passive position and its abutment against the bobbin or empty casing circumference allows for a precise determination of the actual outer diameter of the bobbin or empty casing.

Another variation of the method, in which the thread spinning length is constantly determined and stored, is presently disclosed. The respective thread spinning length of each spinning station is stored in a control unit in the machine control room. Deviations caused by the material of the thread only have an effect in the case of larger bobbin outer diameters. However, since in the case of larger bobbin outer diameters the differences between the circumferential velocity at the longitudinal center of the bobbin and the bobbin ends become smaller, the material-related deviations are then also compensated for.

Presently disclosed devices are particularly suitable for carrying out the present method, in which are provided a bobbin, which is driven by a drive device, and a control unit, which is connected in respect of velocity control with the drive device for the bobbin. Sensors or light barriers are actuated successively over the increasing outer diameter of the bobbin, so that they are in a position to precisely inform the control unit of the actual outer diameter. Sensors or light barriers of this type are operationally reliable and can be accommodated in a space-saving manner.

Another embodiment of the device is presently disclosed, which device comprises a bobbin and the pivotable bobbin carrier arms, which support the bobbin and which can be pivoted during thread attachment to a degree related to the actual outer diameter of the bobbin into a bobbin release position. In an advantageous manner, components which are already contained in the device are used for determining the actual outer diameter. In this connection, it is not necessary in order to determine the actual outer diameter to enter into the direct area of movement of the bobbin. The actual outer diameter is precisely determined at a point at a distance from the bobbin. In this respect, a potentiometer-based embodiment of the device as presently disclosed has proved expedient in practice. A potentiometer or a timing circuit are components which operate reliably, are dirt-resistant, are compact and produce good, usable signals.

A further, alternative embodiment of the device is also presently disclosed, in which an auxiliary drive roller is provided for driving the bobbin during thread attachment, which roller can be pivoted between a predetermined passive position and a drive position on the bobbin circumference dependent upon the actual outer diameter, the auxiliary drive roller being connected with a drive device controlled by the control unit. In this case too, the measuring device is used which is at a distance from the area of movement of the bobbin, so that the respective actual outer diameter can be determined and transmitted to the control unit using components which are necessary anyway for the operation of the device.

Finally, another presently disclosed embodiment of the device according to this invention is also expedient, in which a control unit is provided, which is in connection with draw-off rollers supplying the thread and with a drive device for the bobbin and comprises a computer component which constantly determines and stores the thread spinning length. Since the control unit is informed of the thread spinning length anyway, it requires no significant additional cost to extend the computer component so that it determines the actual outer diameter of the bobbin during thread attachment from predetermined and stored values relating to the thread spinning length and places the control unit in a position to impart the necessary change in velocity for the drive device.

BRIEF DESCRIPTION OF THE DRAWINGS

The invention is explained by way of the following description and embodiments illustrated in the drawings, in which:

FIG. 1 is a schematic representation of a present device for winding conical bobbins;

FIG. 3 shows a detail variant, and

DETAILED DESCRIPTION OF THE PREFERRED EMBODIMENTS

Figure 4:
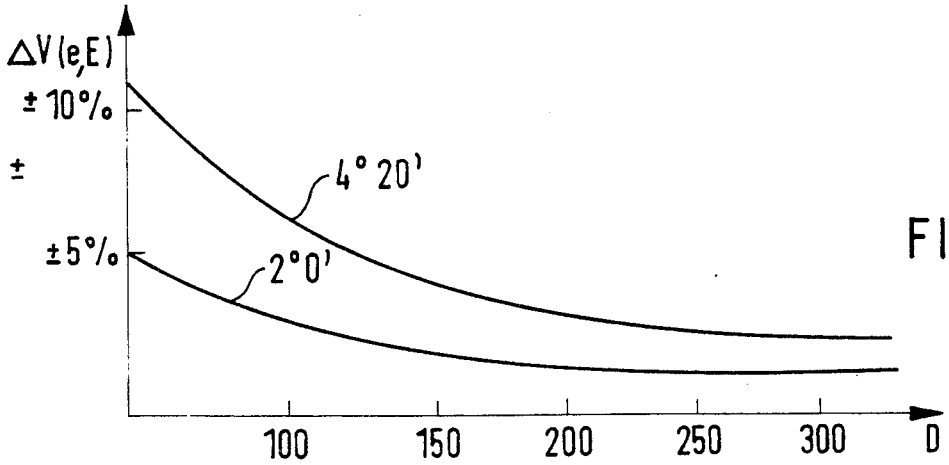
FIG. 4 is a graph showing the differences in velocity of a bobbin with different conicities and different mean outer diameters.

If a conical bobbin 6 (FIG. 2) or empty casing 7 is driven in its longitudinal center M (FIG. 1) by means of a drive roller 9 over its outer diameter D in the central longitudinal region at a predetermined operating velocity, then the circumferential velocities in the vicinity of the two ends e and E will differ considerably from the operating velocity on account of the outer diameters D2 and D1 at these points, which differ from the central outer diameter D. The graph according to FIG. 4 illustrates in curve form said velocity difference $\Delta V$ (e, E) for example for a bobbin having a conicity of 2° and a bobbin having a conicity of 4 ° 20'. In this graph, the central outer diameter D is shown on the horizontal axis, whilst the change in velocity is given in percent on the vertical axis. In this respect, the vertical axis reflects the positive and negative changes in velocity $\Delta V$ (e, E) which result between the outer diameter D and the outer diameters D1 and D2 at the two ends e and E of the bobbin 6. The values for the changes in velocity $\Delta V$ (e, E) which are to be taken into account are empirically determined for different conicities and fiber materials. For example, a bobbin 6 having a conicity of 2°, results in a change in velocity of approx. +5%, whereas the change in velocity in the case of a 4° 20'bobbin, e.g. an empty bobbin casing 7, is more than +10%. It can also be clearly seen from the graph according to FIG. 4 that said differences in velocity gradually become smaller as the central outer diameter D increases. It is therefore clear from the graph that the supplied thread is wound onto the bobbin up to 15% too quickly in the case of an empty bobbin casing after a bobbin change-over and with the formation of the conventional thread reserve $F_R$ (FIG. 1) at the end E of the bobbin 6 with the larger diameter D1, which causes an increase in the thread tension which can lead to a thread break, although the empty casing 7 is driven in its central longitudinal region at the thread supply velocity. Conversely, during a thread attachment process which is carried out at the end e of the empty casing 7 or bobbin 6 with the small diameter D2, the circumferential velocity of the empty casing 7 or bobbin 6 in the take-up area of the thread F is no longer sufficient to maintain the basic predetermined thread tension, so that the thread F becomes loose and produces an uneven winding pattern.

In order to dispense with these above-mentioned disadvantages, the drive velocity of the empty casing 7 or bobbin 6 is changed relative to the operating velocity during a thread attachment process, i.e. is increased or reduced in order to ensure a uniform take-up of the thread approaching at a predetermined supply velocity. In this respect, the circumferential velocity of the empty casing 7 or bobbin 6 is changed as a strict function of the actual outer diameter D, D1 or D2 of the empty casing 7 or bobbin 6 (of curves of FIG. 4) and as a function of the respective conicity of the bobbin 6. To this end it is, however, necessary to determine the actual outer diameter.

At a spinning station 1 shown schematically in FIG. 1, the thread F emerges from a spinning element designed, for example, as an OE rotor 2. The thread passes between draw-off rollers 3, which are in connection with a drive device 4 and determine the feed velocity of the thread F.

The empty casing 7 or bobbin 6 are rotatably held in conventional manner by bobbin carrier arms 5, expediently with the aid of bobbin plates 8 and 8*a*. In the longitudinal center M of the bobbin 6, a drive roller 9 engages at the outer circumference of the bobbin at the actual central diameter D, which drive roller 9 can be the main drive for winding or an auxiliary drive and is in movement-transferring connection with a drive device 10.

For a thread attachment process in association with a bobbin change-over or also for a thread break correction, a centering spindle 11 is used, which is connected with a drive device 12 and comprises a part with a small diameter ending with a delivery end 13. The centering spindle 11 is provided in conventional manner with oppositely directed thread tracks 110, 111 on its surface and with a central centering groove 112, so that a centering of the thread F is just as possible as a compulsory movement of the thread F in the direction of the smaller end e or in the direction of the larger end E of the bobbin 6. So as to cross wind the thread F, a shifting thread guide 14 is also provided, which is moved to and fro in the longitudinal direction of the bobbin 6 and guides the thread F. The thread guide 14 is not used during thread attachment.

Furthermore, a control unit designated 15 is provided, which controls the individual components of the spinning station 1. The control unit comprises, for example, an input part 16 and a computer component 40 (e.g. a microprocessor) with stores 42 and 43. The drive device 10 for the bobbin 6 is connected via a control line 17 to the control unit 15, whilst the devices 12 and 4 for the centering spindle 11 or the draw-off rollers 3 are connected to the control unit 15 via the control lines or signal lines 18 and 19.

During cross-winding and the operation of the thread guide 14, the control unit 15 imparts the drive device 10 with an operating velocity resulting from the feed velocity of the draw-off rollers 3. The changes in velocity which then result during the winding on of the thread F between the longitudinal center M and the two ends e and E of the bobbin 6 are either compensated by compensating means, not shown, for the thread tension, or by a corresponding control of the movement of the thread guide 14. However, particularly during thread attachment the drive velocity of the drive device 10 and therefore of the drive roller 9 is changed relative to the operating velocity as a function of the actual outer diameter of the bobbin 6 in such a manner that the circumferential velocity of the bobbin 6 in the uptake region of the thread F corresponds to the supply velocity. In this respect, the uptake region of the thread F is understood to be the region of the empty casing 7 or bobbin 6 onto which the thread F runs during thread attachment, i.e. during the formation of the thread reserve $F_R$ shown in FIG. 1. This means that with a bobbin change-over with subsequent thread attachment, in which the thread reserve $F_R$ is formed at the end E of the empty casing 7 with the large diameter D1, the drive velocity of the empty casing 7 is correspondingly reduced relative to the operating velocity after the completed thread attachment process, whilst the drive velocity is increased relative to the operating velocity during a thread attachment at the end e with the smaller diameter D2.

In the embodiment according to FIG. 1, a change in the drive velocity is possible in that, in the control unit 15 in the computing component 40, which is preprogrammed with corresponding data relating to the conicity of the bobbin 6 and predetermined thread spinning length values corresponding to different actual outer diameter values, for example by monitoring the number of revolutions of the draw-off rollers 3, the thread spinning length is constantly determined and stored, so that the computing component 40 can precisely determine the actual outer diameter D, D1 or D2 from the respective thread spinning length. Furthermore, the computing component 40 is preprogrammed according to one of the curves of FIG. 4, such that it firstly determines the actual outer diameter from the actual thread spinning length and from the actual outer diameter determines the necessary change in the drive velocity of the drive device 10. During a bobbin change-over the thread spinning length is still zero, so that, with a known bobbin size and conicity, the computing component 40 determines the maximum change (of FIG. 4) in the drive velocity. With an increasing thread spinning length, the computing component 40 determines the respective actual outer diameter, expediently the actual central outer diameter D of the bobbin 6, and thereby calculates the degree of the change in velocity for the drive device 10 which is necessary, for example, for a thread attachment process. In this connection, a different increase in the bobbin diameter when working with different thread materials can be taken into account by corresponding programming.

As soon as the thread attachment process is complete and the thread guide 14 takes up the thread F for the shifting cross winding movement, the computing component 40 is deactivated, whereupon the drive unit 10 is again imparted by the control unit 15 with the operating velocity predetermined by the draw-off rollers 3.

Figure 2:
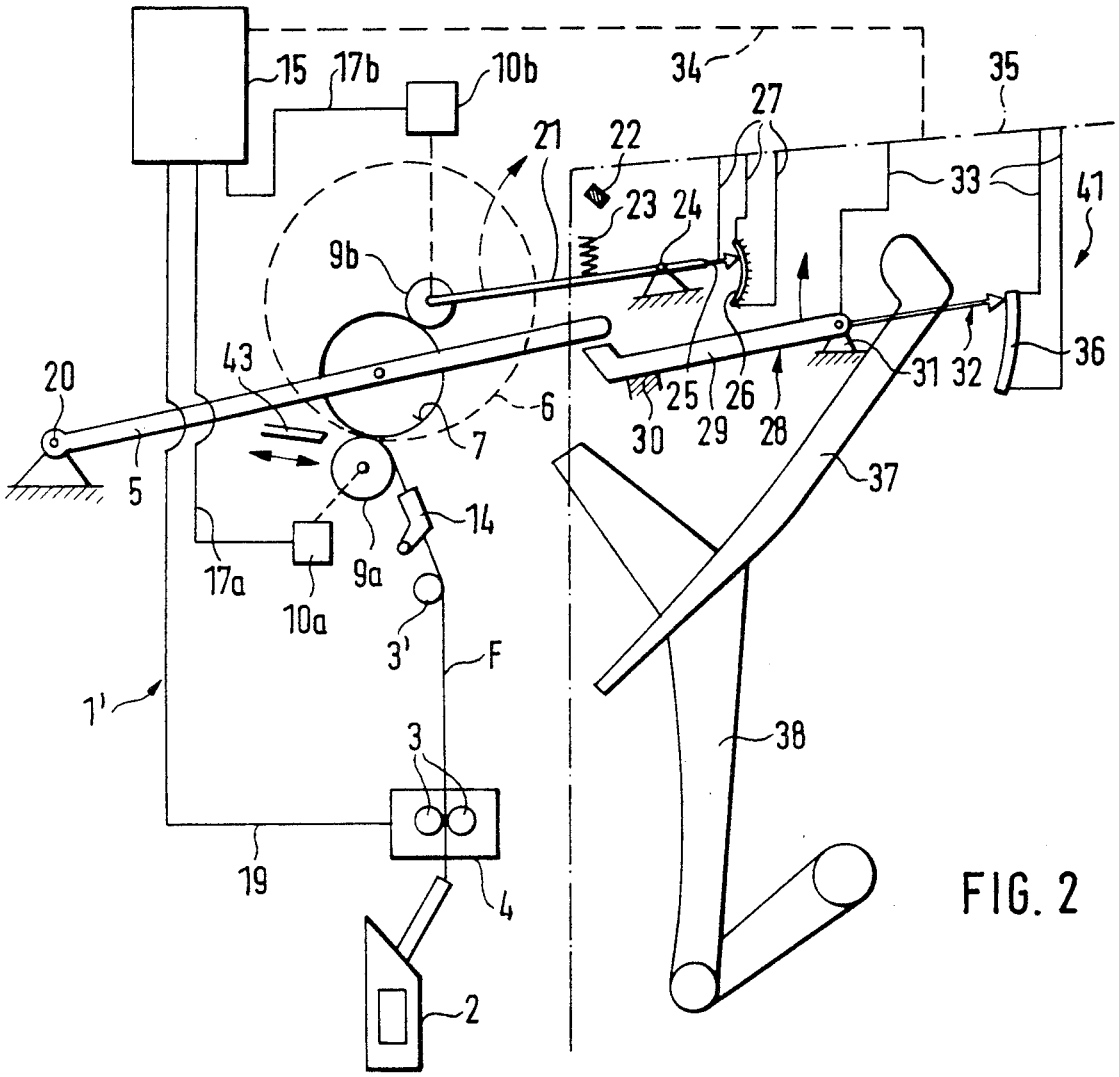
FIG. 2 is a different view of a modified embodiment of the device.

In another embodiment (FIG. 2) of a spinning station 1' of this type according to FIG. 2, two alternative solutions to determine the actual outer diameter of the bobbin 6 or the empty casing 7 are shown, of which in practice only one is used. At the spinning station 1' components of FIG. 1, corresponding components are provided with the same or like reference numbers.

The thread F passes between the draw-off rollers 3 and is deflected on a deflection roller 3', which can also be a compensating device, so as then to be wound via the bobbin roller 9*a* onto the empty casing 7 or bobbin 6 indicated by broken lines. In this connection, the thread guide 14 undertakes the shifting function during the normal cross winding process.

The bobbin roller 9a is connected with a drive device 10a, which is connected via a control line 17a to the control unit 15. The empty casing 7 or bobbin 6 is supported by the bobbin carrier arms 5, which are fixedly but pivotably mounted in a swivel bearing 20. In the event of a thread break, or during a bobbin change-over or thread attachment, a separating element 43, which promptly interrupts the drive of the bobbin 6 by the main drive roller 9a, can be pushed between the bobbin roller 9a and the bobbin 6.

On the other side of the carrier arms 5 a swivel mounting 21 for an auxiliary drive roller 9b is provided, which roller is connected with a drive 10b which is connected via a control line 17b to the control unit 15. The swivel mounting 21 is provided with a displacement device, not shown, by means of which the auxiliary drive roller 9b can be moved from a passive position determined by a stop 22 to rest against the circumference of the bobbin 6, a spring 23 supplying the contact pressure of the auxiliary drive roller 9b. The swivel mounting 21 is mounted in a stationary swivel bearing 24, e.g. in a servicing device 41, which can be driven to and fro in front of the spinning stations of a spinning device can be positioned in front of the respective spinning station for a bobbin change-over or for a thread attachment.

A sensor 25 is arranged on the swivel mounting 21, which sensor cooperates with a potentiometer or a timing circuit, which forms a measuring device 26, by means of which the degree of and/or the time taken for the (uniform)movement of the swivel mounting 21 out of the passive position against the stop 22 to abutment against the circumference of the bobbin 6 can be determined and converted into a control signal. Since the auxiliary drive roller 9b reaches the circumference of the bobbin 6 earlier the greater the actual outer diameter D of the bobbin 6, the degree of movement of the swivel mounting 21 or the time taken to effect said movement is a criterion for the actual outer diameter D. The measuring device 26 is connected via connecting lines 27 to a cutting site 35 and is connected via the latter and via a control line 34 to the control unit 15. Since the auxiliary drive roller 9b is only used during a thread attachment process, when the bobbin roller 9a is not in driving contact with the bobbin 6 or empty casing 7, the actual order diameter D of the bobbin 6 or empty casing 7 can be simply determined in this manner, so that the control unit 15 is in a position to impart the drive device 10b with the drive velocity.

In the servicing device 41, a support device 28 for the bobbin carrier arms 5 is also provided and used during change-overs or a thread attachment process. The support device 28 comprises a support fork 29, which normally adopts its end position on a stop 30. Said support form 29 is pivotable about a swivel bearing 31 and is acted upon by a motion drive, not shown, so as to lift the bobbin carrier arms 5 during a bobbin change-over or thread attachment, so that the bobbin 6 no longer cooperates with the bobbin roller 9a, but with the auxiliary drive roller 9b. In this connection, the support device 28 is only displaced until the bobbin circumference is at a predetermined distance from the bobbin roller 9a. Since the degree of the pivoting movement of the support device 28 therefore varies as a function of the actual outer diameter of the bobbin 6, the degree of the pivoting movement can be used to determine the actual outer diameter D of the bobbin 6. Although the bobbin carrier arms 5 are pivoted as a function of the respective actual outer diameter D of the bobbin 6 through the same pivoting path in each case—so as to move the bobbin circumference away from the bobbin roller 9a by a predetermined degree, the position of the pivoting area changes, so that this different pivoting area position can be used to determine the actual outer diameter D of the bobbin 6 or the empty casing 7.

If the support device 28 is displaced at a uniform velocity, in order to move the bobbin circumference away from the bobbin roller 9a by the specified degree, then the time taken for said pivoting movement can be used to determined the actual central outer diameter D of the empty casing 7 or bobbin 6.

In contrast to the design designed earlier, in the illustrated embodiment an extension pointer 32 is mounted on the fork 29, which pointer can be displaced along a potentiometer or a time circuit 36 and is in a position to send signals to the cutting site 35 via the lines 33, which signals represent the respective actual outer diameter D and which place the control unit 15 into a position to control the drive device 10b accordingly, i.e. by reducing or increasing the drive velocity relative to the feed velocity of the thread F. The support device 28 is also contained within the servicing unit 41, so that the servicing unit 41 is used to transmit the actual outer diameter D of all existing spinning stations, when a thread attachment process is due, to the control unit 15, which is expediently the central control unit of the spinning device.

In conventional manner, the servicing unit 41 also contains a thread suction device 37 and a pivotable suction pipe 38 and other means, not shown, which are required for the thread attachment and/or bobbin change-over. However, said means have nothing to do with the velocity control during thread attachment or bobbin change-overs, so that for the sake of simplicity reference is made to DE-OS-3 123 494, which corresponds with U.S. Pat. No. 4,501,116, which provides clear information in this respect.

FIG. 3 clearly shows a detail variant for determining the actual outer diameter D of the bobbin 6 or empty casing 7. According to this diagram, opto-electronic sensors, which either move together with the bobbin carrier arms 5 or are stationary relative to the axis of the bobbin 6, or other non-moving sensors or light barriers L1 to L4 are provided and are arranged in a row such that with an increasing actual outer diameter D the bobbin 6 covers an increasing number of light barriers L1 to L4, which are connected in a signal-transmitting manner via control liens 39 with the control unit 15 and supply signals representing the actual outer diameter D of the bobbin 6, from which signals the control unit 15 can effect the change in the drive velocity of the bobbin 6 during thread attachment in the above-mentioned manner. The light barriers L1 to L4 are expediently associated with the central outer diameter D of the bobbin 6. It is, however, conceivable to scan the small or large actual diameter D1 or D2 of the bobbin 6 at its ends e or E.

What is claimed is:

1. A method for winding conical cross-wound bobbins, more particularly for open end spinning, in which the thread provided with a specific velocity by draw-off rollers is supplied to a bobbin or an empty casing, which is driven during the winding process by a drive device controlled by a control unit at an operating velocity adapted to the thread supply velocity, said method comprising:

determining an actual outer diameter of the bobbin or the empty casing; and changing the drive velocity of the bobbin or empty casing relative to the operating velocity at least during a thread attachment phase as a function of the determined actual outer diameter of the bobbin or empty casing, such that the circumferential velocity of the bobbin or empty casing in the take-up region of the thread arranged axially at a distance from the longitudinal center of the bobbin or empty casing corresponds with the thread supply velocity, which circumferential velocity would otherwise deviate from the thread supply velocity on account of the conicity of the bobbin or empty casing.

2. A method according to claim 1, wherein said changing step includes controlling the drive velocity during the winding of the thread at the end of the bobbin with the larger diameter so that it is throttled relative to the operating speed as a function of the determined actual outer diameter.

3. A method to claim 1, wherein said changing step includes controlling the drive velocity so that it is changed by up to 15% relative to the operating velocity.

4. A method according to claim 1, wherein the actual central outer diameter of the bobbin or empty casing is determined and transmitted by data transfer to the control unit, and is evaluated by the control unit to determine the degree of the required change in the drive velocity.

5. A method according to claim 1, in which, for thread attachment, the bobbin or empty casing held by bobbin carrier arms is pivoted by a carrier arm support device out of the operating position into a predetermined bobbin release position, characterised in that the actual outer diameter of the bobbin or empty casing is determined on the basis of the degree of the pivoting movement into the bobbin release position or the time taken to effect said pivoting movement of the support device.

6. A method according to claim 5, in which an auxiliary roller provided for thread attachment can be moved from a passive position to abut against the circumference of the bobbin or empty casing, characterised in that the actual outer diameter of the bobbin or empty casing is determined on the basis of the degree of or the time taken for the movement of the auxiliary roller between the passive position and abutment against the circumference of the bobbin or empty casing.

7. A method according to claim 1, further including constantly determining and storing the thread spinning length, and wherein the actual outer diameter of the bobbin or empty casing is determined by the step of comparing stored bobbin outer diameters corresponding to predetermined thread spinning lengths with the constantly determined thread spinning length.

8. A device for winding conical cross-wound bobbins, particularly for open-end spinning, including:

draw-off rollers for supplying thread with a specific velocity to a bobbin or an empty casing;

a drive device for driving the bobbin or empty casing during a winding process;

control means for controlling said drive device to operate at an operating velocity adapted to the thread supply velocity; and means for determining the actual outer diameter of the bobbin or the empty casing;

wherein said control means functions to change the drive velocity of the bobbin or empty casing relative to the operating velocity at least during a thread attachment phase as a function of said determined actual outer diameter of the bobbin or empty casing, such that the circumferential velocity of the bobbin or empty casing in the take-up region of the thread arranged axially at a distance from the longitudinal center of the bobbin or empty casing corresponds with the thread supply velocity.

9. A device according to claim 8, further including a plurality of sensors which are stationary relative to the bobbin or empty casing, and arranged in a row and actuated successively as the outer diameter of the bobbin increases, with outputs of said sensors being connected with the control means.

10. A device according to claim 8, further comprising: pivotable bobbin carrier arms bearing a bobbin or empty casing, which carrier arms can be pivoted during thread attachment by a degree dependent upon the actual outer diameter of the bobbin or empty casing into a bobbin release position; and a measuring device for measuring the movement of the bobbin carrier arms into the bobbin release position and connected with the control means which is responsive thereto for actual outer diameter determination.

11. A device according to claim 10, further including a carrier arm support device, which can be swung out of a servicing device arranged in front of the spinning station, and brought up to the bobbin carrier arms, wherein said measuring device measures the degree of or time taken for the movement of the support device.

12. A device according to claim 11, wherein said measuring device comprises a potentiometer or a timing circuit, by means of which a control signal, such as a control voltage value, representing the degree of or time taken for the pivoting movement of said support device can be produced for said control means.

13. A device according to claim 8, further comprising: an auxiliary drive roller for driving the bobbin or empty casing during thread attachment, which auxiliary drive roller can be pivoted between a predetermined passive position and a drive position against the circumference of the bobbin or empty casing, said position being dependent upon the actual outer diameter of the bobbin or empty casing, the auxiliary drive roller being connected with said drive device controlled by said control means; and a measuring device for measuring the degree of or time taken for the respective movement of the auxiliary drive roller, and arranged in the path of movement of the pivot mounting for said auxiliary drive roller and connected with said control means which is responsive thereto for actual outer diameter determinations.

14. A device according to claim 8, wherein said control means is connected with the draw-off rollers supplying the thread, and has a computing component which constantly determines and stores the thread spinning length, wherein said computing component comprises at least one re-readable store and a describable store, wherein values of the actual outer diameter of the bobbin or empty casing associated with predetermined thread spinning length values for at least one bobbin size and conicity are stored in the re-readable store at specific storage locations, wherein the thread spinning length in the spinning station and the supply velocity of the thread can be constantly stored in the describable store, and wherein the computing component can be actuated at least during a thread attached in order to determine for the control means from the actual thread spinning length, the actual outer diameter of the bobbin or empty casing and from the supply velocity via the actual outer diameter of the bobbin or the empty casing, the change in the drive velocity of the drive device and to correspondingly impart said drive device with such change.

* * * * *